United States Patent [19]

Kokelenberg et al.

[11] 4,039,332

[45] Aug. 2, 1977

[54] STABILIZATION OF PHOTOSENSITIVE RECORDING MATERIAL

[75] Inventors: Hendrik Emmanuel Kokelenberg, Wilrijk; Rafaël Pierre Samijn, Hoboken; Jozef Willy Van den Houte, Berchem; Robert Joseph Pollet, Vremde, all of Belgium

[73] Assignee: AGFA-GEVAERT N.V., Mortsel, Belgium

[21] Appl. No.: 720,450

[22] Filed: Sept. 3, 1976

Related U.S. Application Data

[63] Continuation of Ser. No. 507,446, Sept. 19, 1974, abandoned.

[30] Foreign Application Priority Data

Sept. 20, 1973 United Kingdom ..... 44200/73

[51] Int. Cl.[2] ..... G03C 5/24; G03C 1/48

[52] U.S. Cl. ..... 96/48 R; 96/76 R; 96/90 R; 96/90 PC

[58] Field of Search ..... 96/48 R, 76 R, 67, 90 R, 96/90 PC

[56] References Cited

U.S. PATENT DOCUMENTS

| | | | |
|---|---|---|---|
| 3,042,515 | 7/1962 | Wainer | 96/90 R |
| 3,140,948 | 7/1964 | Stewart | 96/90 R |
| 3,275,443 | 9/1966 | Wainer | 96/90 R |
| 3,502,476 | 3/1970 | Itano et al. | 96/90 R |
| 3,813,245 | 5/1974 | Laridon et al. | 96/90 R |

*Primary Examiner*—Won H. Louie, Jr.
*Attorney, Agent, or Firm*—William J. Daniel

[57] ABSTRACT

A recording process including image stabilization comprising the steps of:

1. image-wise exposing to active electromagnetic radiation of a recording material containing in a recording layer a dye precursor compound and at least one photosensitive organic polyhalogen compound capable of producing photoradicals and a dyestuff with said dye precursor compound when exposed with ultraviolet radiation and/or visible light, and
2. heating the photoexposed recording material thereby transforming the non-decomposed polyhalogen compound into a non-photosensitive substance by reaction with at least one stabilizing substance selected from the group consisting of triphenylamine, a soft base containing an element of the group consisting of phosphorus, arsenic, antimony, bismuth, selenium, and tellurium, and an $\alpha,\beta$-ethylenically unsaturated compound in which at least the $\alpha$-carbon atom of at least one ethylene group is linked to cyano, a cyanomethyl group, an acyl group, an acyloxy group, an alkoxycarbonyl group, a carbamoyl group or an aryl group, said stabilizing substance(s) being available in a layer adjacent to the recording layer for allowing on heating the reaction with non-photo-decomposed polyhalogen compound.

13 Claims, No Drawings

STABILIZATION OF PHOTOSENSITIVE RECORDING MATERIAL

This is a continuation, of Ser. No. 507,446, filed Sept. 19, 1974 now abandoned.

The present invention is directed to a recording method for forming a permanent or stabilized image resulting from the information-wise exposure of a free radical photo-sensitive material as hereinafter defined, wherein said method includes the inactivation of the photosensitivity of the compound producing the free radical.

By the term "free radical photosensitive material" employed in the present description is meant a photosensitive material in which at least one of the photosensitive ingredients is an ultraviolet and/or visible light sensitive organic polyhalogen compound producing photoradicals on exposure with said radiation.

Photographic dye-forming systems based on the use of said polyhalogen compound and a dye precursor compound have been described, e.g., by R. A. Fotland in J. Phot. Sci., 18 (1970), 33–37, in the U.S. Pat. Nos. 3,102,810 and 3,377,167, the United Kindom Pat. Nos. 1,151,578 and 1,073,345 and in the Belgian Pat. Nos. 771,848; 786,973; 787,339 and 790,340 corresponding with the United Kingdom Pat. application Nos. 41,749/70, 40,349/71, 42,802/71 and 48,804/71 respectively.

In all these dye-forming systems carbon tetrabromide and/or iodoform are the most commonly used photoradical-generating compounds because these compounds excel in photosensitivity when compared with other representatives of the class of photosensitive organic polyhalogen compounds.

One of the presently known stabilization techniques makes use of the volatility of the carbon tetrabromide, which can be removed from the non-exposed portions of the recording material relatively easily by evaporation. A suitable stabilization temperature is, e.g., in the range of 100° to 150° C.

The evaporation of carbon tetrabromide in the environment of the operating personel poses, however, a problem since the compound is physiologically not inert and classified as being toxic (see I. Sax, Dangerous Properties of Industrial Materials (1968).

The toxicity problem still remains when applying another commonly used stabilization technique that is based on the extraction of the photosensitive polyhalogen compound.

In the known extraction-stabilization technique a solvent for the photosensitive polyhalogen compound is used, which solvent does not affect or only weakly affects the binding agent of the recording layer. Some solvents such as diethyl ether, although being excellent extraction agents cannot be used for the risk of explosion. Other suitable extraction solvents belonging to the class of liquid halogenated aliphatic hydrocarbons are not miscible with water and must not be drained off in the sewer.

Now a recording process has been found including image stabilization comprising the steps of:

1. image-wise exposing to active electromagnetic radiation a recording material containing in a recording layer a dye precursor compound and at least one photosensitive organic polyhalogen compound capable of producing photoradicals and a dyestuff with said dye precursor compound when exposed with ultraviolet radiation and/or visible light, and
2. by heating transforming the non-decomposed polyhalogen compound into a non-photosensitive substance by reaction with at least one stabilising substance selected from the group consisting of triphenylamina, a "soft-base" containing an element of the group consisting of phosphorus, arsenic, antimony, bismuth, selenium and tellurium.

and an $\alpha,\beta$-ethylenically unsaturated compound in which at least the $\alpha$-carbon atom of at least one ethylene group is linked to cyano, a cyanomethyl group, an acyl group, an acyloxy group, an alkoxycarbonyl group, a carbamoyl group or an aryl group, said stabilizing substance(s) being available in a layer adjacent to the recording layer for allowing the reaction with non-photodecomposed polyhalogen compound on heating.

By the wording "soft base" is understood in the present invention a substance whose logarithm of the reaction rate constant of the reaction of the base with the trans-Pt $(C_5H_5N)_2Cl_2$ complex is larger than 3. Soft bases having that property are described in Science 151, 172–7 (1966) and in J. Chem. Educ. 45, 581–587 (1968) more particularly in Table 3 of the article "Acids and Bases, HSAB" by Ralph G. Pearson.

The present invention includes further an integral copy material containing the photosensitive polyhalogen compound and stabilizing agent out of direct chemical contact from each other at room temperature (20°–30° C) but in such a condition that reactive contact is effected through heating of the material at a temperature above 60° C.

In the integral copy material system different techniques of keeping the polyhalogen compound and the soft base and/or sterically hindered phenol out of reactive chemical contact below 60° C may be applied. For example, the reactants are kept out of direct chemical contact by enveloping at least one of the reactants in a capsule or droplet that contains a shell or envelope of a material, normally a polymeric material or wax that prevents the direct contact with the other reactant. The capsule shell or droplet envelope is ruptured of softened by heating, as a result of which the reactants enter into reactive contact.

Preferred integral copy materials applied in the present invention contain the photosensitive organic polyhalogen compound and stabilizing substance out of chemical reactive contact at least below 60° C in apart binder layers in which the layer containing the stabilizing substance is a layer adjacent to the layer containing the polyhalogen compound and is applied from a solution in a volatile liquid, which is a non-solvent for the polyhalogen compound and the binder contained in the imaging layer comprising the polyhalogen compound and dye precursor compound. Premature reaction is avoided effectively when in a first layer on the support, e.g. resin support, of the recording material a vinyl carbazole homopolymer or copolymer binder containing the dye precursor compound, e.g. a spiropyran compound and polyhalogen compound and being insoluble or poorly soluble in ethanol or methanol, is coated and the stabilizing substance is applied in a polymeric binder that is highly soluble in ethanol. Preferred binders for the covering layer are cellulose nitrate, polyvinyl acetate, ethylcellulose and polyvinylbutyral.

If coated on a removable carrier, the very vinylcarbazole polymer or copolymer film containing the dye precursor compound and polyhalogen compound may serve as the support but preferably it is permanently supported on a separate heat-resistant film, e.g. a polyester resin film, preferably a polyethylene terephthalate film. The ratio of vinyl carbazole, homopolymer or copolymer to dye precursor compound in the integral sheet system material may be in the range of about 20 to 2 parts by weight of polymer to 1 part by weight of dye precursor compound.

The triphenylamine and soft base stabilizing agent are preferably present in the recording material at least in equimolar amount with respect to the photosensitive polyhalogen compound.

The molar amount of $\alpha,\beta$-ethylenically unsaturated compound is preferably at least 2 times as large as the molar amount of the photosensitive polyhalogen compound in the recording material.

If plasticizers are used in the layer containing the triphenylamine, soft base and/or $\alpha,\beta$-ethylenically unsaturated compound preference is given to those that do not opacify the recording material, in other words those that are compatible with the binder, e.g. cellulose nitrate. The plasticizer should therefore be soluble in the same solvent as the binder. It should be essentially nonvolatile in normale storage conditions. Suitable plasticizers for celulose nitrate are polyalkylene glycol and camphor.

Particularly useful stabilizing agents of the soft base type of the elements phosphorus, arsenic, antimony or bismuth correspond to the following structural formula:

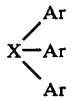

wherein:

X is phosphorus, arsenic, antimony or bismuth, and

Ar is an aryl group e.g. a phenyl group.

The use of such triaryl compounds in a photosensitive mixture containing a leuco dye compound and a photosensitive organic halogen compound has been described already in the United Kingdom patent specification No. 1,161,058.

Preferred stabilizing agents of the soft base type are given in the following Table 1 with their structural formula, melting point and reference to their preparation.

Table 1

| No. | Structural formula | Melting point or Boiling point (° C) | Preparation ref. |
|---|---|---|---|
| 1 | 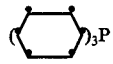 | 74–76 | P. Pfeiffer, Ber. 37,4620(1904) |
| 2 | 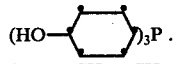 | 200 | O. Neunhoeffer, Ber., 94, 2515 (1961) |
| 3 | $(CH_3-CH_2-CH_2-CH_2)_3P$ | b.p. 150 (50 mm Hg) | W. Davies, J. Chem. Soc., 1929 33 |
| 4 | 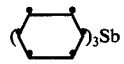 | 50 | G. Hiers, Org. Synt. Coll. Vol. 1 535 |
| 5 | 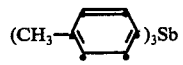 | 127 | T. Talalaevce J.Gen. Chem. U.S.S.R. 16 777 (1946) |
| 6 | 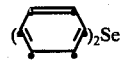 | b.p. 165 (12 mm Hg) | H. Leicester, Org. Synth. Coll. Vol. II, 238 |

$\alpha,\beta$-Ethylenically unsatured compounds for use as stabilizing agents according to the present invention correspond to the following general formula:

$$X-(CH=CH-)_nY$$

wherein:

X represents an aryl group e.g. phenyl, CN, $-CH_2CN$, an acyl group e.g. benzoyl, an acyloxy group, an alkoxycarbonyl group, an aryloxycarbonyl group or a carbamoyl group, Y represents hydrogen or one of the groups mentioned under X, and $n$ is 1 or 2.

Preferred unsaturated compounds are given in the following Table 2 with their structural formula, melting point and reference to their preparation.

Table 2

| No. | Structural formula | Boiling point (bp) or melting point (mp) (° C) | Preparation ref. |
|---|---|---|---|
| 1 | $CH_2=CH-CN$ | (bp) 78 | C. Monreu, Bull.Soc. Chim.France (4) 27, 903 |
| 2 | $CH_3-\underset{\underset{O}{\|}}{C}-O-CH=CH_2$ | (bp) 72 | A. Sladkov, J.Gen. Chem. U.S.S.R., 24, 459(1954) |
| 3 | $CH_2=CH-CH_2CN$ | (bp) 118 | P. Bruylants, Bull. Soc.Chim.Belge 31, 176 |
| 4 | 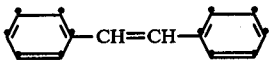 | (mp) 125 | Beilstein, E II Vol.5 (1943), 537 |
| 5 | 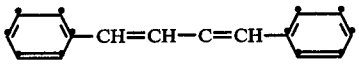 | (mp) 147 | Beilstein, E II Vol.5 (1943), 589 |
| 6 | 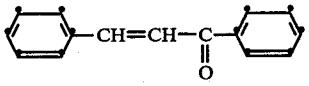 | (mp) 59 | Beilstein, E II Vol.7 (1948), 423 |

The above mentioned stabilizing agents that are particularly advantageously used in conjunction with carbon tetrabromide are also effective in the stabilization of photosensitive materials containing photosensitive organic polyhalogen compounds other than carbon tetrabromide.

Photosensitive organic polyhalogen compounds that obtain reduced photosensitivity by reaction with the mentioned stabilizing agents are within the scope of the following general formula that includes carbon tetrabromide:

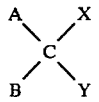

wherein:

each of A, B, X and Y is a halogen atom of the group of chlorine, bromine or iodine, or wherein one of said radicals A, B, X or Y represents an alkyl group, including a substituted alkyl group, e.g. a halogen-substituted alkyl radical, a hydroxyalkyl radical or an aralkyl, e.g. benzyl, a quinoxaline group, an aryl group, a substituted aryl group, an aroyl group or an aryl sulphonyl group and the other radicals chlorine, bromine or iodine, or wherein two of said radicals A, B, X or Y represent an aromatic acyl group, e.g. benzoyl, and the other radicals chlorine, bromine or iodine.

Particularly suitable representatives falling within the scope of that general formula are organic halides such as carbon tetrabromide, bromoform, iodoform, hexachloroethane, hexabromoethane, pentabromoethane, 1,1,2,2-tetrabromoethane, α,α,α-tribromoacetophenone, α,α,α-tribromomethylsulphonylbenzene, and its chlorine- or nitro-substituted derivatives, tribromoethanol and the 2-tribromomethylquinoxaline compounds described in Belgian Pat. No. 757,145.

The following examples illustrate the present invention without, however, limiting it thereto. The parts, percentages and ratios are by weight, unless otherwise indicated.

EXAMPLE 1

24 Parts of carbon tetrabromide, 24 parts of iodoform, 24 parts of 3-methyl-di-β-naphthospiropyran, 100 parts of poly-N-vinylcarbazole, 2 parts of silicone oil dissolved in 1446 parts of trichloroethylene and 1336 parts of methylene chloride were used for the coating of the imaging layer A on a polyethylene terephthalate support of a coverage of 95 ml per sq.m.

The stabilizing layer B was coated on top of layer A in a ratio of 38 ml per sq.m with the following composition: 50 ml of a 5% solution of cellulose nitrate in ethanol and 50 ml of a 10% solution of triphenylstibine in ethylene glycol monomethyl ether.

After drying, this material was exposed for 20 s to ultraviolet radiation in an Actina SH (trade name) diazo copier containing an U.V. lamp of 1000 W and heated for 8 s at 130° C. A light-stable image was obtained.

EXAMPLE 2

On the same imaging layer as described in Example 1 a stabilizing layer was coated in a ratio of 76 ml per sq.m with the following composition: 50 ml of a 10% ethylcellulose solution in dioxan and 50 ml of a 10% triphenylstibine solution in ethylene glycol monomethyl ether.

After drying, this material was exposed to U.V. radiation, as described in Example 1, heated for 30 s at 130° C (or for 90 s at 120° C). A light-stable image was obtained.

EXAMPLE 3

On the same imaging layer as described in Example 1 a stabilizing layer was coated in a ratio of 76 ml per sq.m with the following composition: 50 ml of a 10% polyvinyl butyral solution in ethanol and 50 ml of a 7% triphenylstibine solution in ethylene glycol monomethyl ether.

After drying, this material was image-wise exposed as described in Example 1, and heated for 6 s at 130° C. A light-stable image was obtained.

EXAMPLE 4

On the same imaging layer as described in Example 1 a stabilizing layer was coated in a ratio of 152 ml per sq.m with the following composition: 50 ml of a 20% polyvinyl acetate solution in methanol and 50 ml of a 12% tritolylstibine solution in benzene.

After drying, this material was image-wise exposed as described in Example 1 and heated for 40 s at 130° C. A stable image was obtained.

EXAMPLE 5

On the same imaging layer as described in Example 1 a stabilizing layer was coated in a ratio of 152 ml per sq.m with the following composition: 50 ml of a 20% cellulose nitrate solution in methanol and 50 ml of a 10% diphenylselenide solution in methanol.

After drying, this material was image-wise exposed as described in Example 1 and heated for 40 s at 130° C. A light-stable image was obtained.

EXAMPLE 6

On the same imaging layer as described in Example 1 a stabilizing layer was coated in a ratio of 152 ml per sq.m with the following composition: 50 ml of a 30% ethylcellulose solution in ethanol and 50 ml of a 12% propene-3-nitrile solution in ethanol.

After drying, this material was image-wise exposed as described in Example 1 and heated for 40 s at 130° C. A light-stable image was obtained.

EXAMPLE 7

On the same imaging layer as described in Example 1 a stabilizing layer was coated in a ratio of 152 ml per sq.m with the following composition: 50 ml of a 20% polyvinyl acetate solution in ethanol and 50 ml of a 10% triphenylphosphine solution in methanol.

After drying, this material was image-wise exposed to U.V. radiation and heated for 40 s at 130° C. A stable image was obtained.

EXAMPLE 8

A polyethylene terephthalate support of a thickness of 0.10 mm was coated in a ratio of 76 ml per sq.m with the following composition: 50 ml of a 10% phenolic resin solution in methanol and 50 ml of a 8% triphenylstibine solution in ethylene glycol monomethyl ether. On this stabilizing layer a light-sensitive layer of the composition of layer A of Example 1 was coated but in a ratio of 152 ml per sq.m.

After drying, this material was exposed to U.V. radiation and heated at 130° C for 2 min. A stable image was obtained.

EXAMPLE 9

A polyethylene terephthalate support of a thickness of 0.10 mm was coated in a ratio of 152 ml per sq.m with the following composition: 12 parts of α,α,α-tribromoquinoxaline-2, 12 parts of 3-methyl-di-β-naphthospiropyran, 50 parts of poly-N-vinylcarbazole, 1 part of silicone oil, dissolved in 1446 parts of trichloroethylene and 1336 parts of methylene chloride.

On top of this imaging layer a stabilizing layer was coated in a ratio of 76 ml per sq.m. with the following composition: 50 ml of a 10% triphenylstibine solution in ethylene glycol monomethyl ether and 50 ml of a 10% ethylcellulose solution in methanol.

After drying, this material was exposed to U.V. radiation and heated for 4 s at 140° C. A light-stable was obtained.

EXAMPLE 10

A polyethylene terephthalate support of a thickness of 0.10 mm was coated in a ratio of 152 ml per sq.m with the following composition: 15 parts of carbon tetrabromide, 15 parts of iodoform, 15 parts of 3-methyl-di-β-naphthospiropyran as dye precursor, 1.5 parts of Michler's ketone, 50 parts of polystyrene, dissolved in 1446 parts of trichloroethylene and 1336 parts of methylene chloride.

On top of this imaging layer a stabilizing layer was coated in a ratio of 76 ml per sq.m with the following composition: 50 ml of a 10% triphenylstibine solution in ethylene glycol monomethyl ether and 50 ml of a 10% ethylcellulose solution in methanol.

After drying, this material was exposed to U.V. radiation and heated for 30 s at 130° C. A light-stable image was obtained.

EXAMPLE 11

A polyethylene terephthalate support of a thickness of 0.10 mm was coated in a ratio of 152 ml per sq.m. with the following composition: 20 parts of carbon tetrabromide, 25 parts of 4-dimethylaminostyrylquinoline as dye precursor, 50 parts of polystyrene dissolved in 1446 parts of trichloroethylene and 1336 parts of methylene chloride.

On top of this imaging layer a stabilizing layer was coated in a ratio of 76 ml per sq.m with the following composition: 50 ml of a 10% triphenylstibine solution in ethylene glycol monomethyl ether and 50 ml of a 10% ethylcellulose solution in methanol.

After drying, this material was exposed to U.V. radiation and heated for 1 min at 130° C. A light-stable image was obtained.

EXAMPLE 12

On the same imaging layer as described in Example 1 a stabilizing layer was coated in a ratio of 50 ml per sq.m with the following composition: 35 ml of a 10% polyvinylbutyral solution in methanol, 10 ml of ethylene glycol monomethylether and 35 ml of a 5% by weight solution in toluol of compound 4 of Table 2.

After drying, this material was exposed to U.V. radiation, as described in Example 1, and heated for 60 s at 130° C. A light-stable image was obtained.

EXAMPLE 13

On the same imaging layer as described in Example 1 a stabilizing layer was coated in a ratio of 76 ml per sq.m with the following composition: 40 ml of a 10% polyvinylbutyral solution in methanol, and 40 ml of a 5% by weight solution in toluol of triphenylamine.

After drying, this material was exposed to U.V. radiation, as described in Example 1, and heated for 60 s at 130° C. A light-stable image was obtained.

EXAMPLE 14

On the same imaging layer as described in Example 1 a stabilizing layer was coated in a ratio of 50 ml per sq.m with the following composition: 40 ml of a 10% polyvinylbutyral solution in methanol, and 40 ml of a 5% by weight solution in ethylene glycol monomethyl ether of compound 6 of Table 2.

After drying, this material was exposed to U.V. radiation, as described in Example 1, heated for 45 s at 130° C. A light-stable image was obtained.

We claim:

1. A recording process including image stabilization comprising the steps of:

1. image-wise exposing to active electromagnetic radiation of a recording material containing in a recording layer a dye precursor compound and at least one photosensitive organic polyhalogen compound capable of producing photoradicals and a dyestuff with said dye precursor compound when exposed with ultraviolet radiation and/or visible light, and
2. heating the photoexposed recording material at a temperature above 60° C while said recording layer is in contact with an adjacent layer containing a molar excess of at least one stabilizing substance selected from the group consisting of (1) triphenylamine, (2) a phenylselenide compound, and 3) an α,β-ethylenically unsaturated compound having the structural formula:

$$X—(CH=CH—)_nY$$

wherein

X represents cyano, a cyanomethyl group, an acyl group, an acyloxy group, an alkoxycarbonyl group, an aryloxycarbonyl group, a carbomoyl group or an aryl group, Y represents hydrogen or a group represented by X, and $n$ is 1 or 2, whereby the nondecomposed polyhalogen compound is transformed by reaction with such stabilizing substance into a non-photosensitive substance.

2. A recording process according to claim 1, wherein the stabilizing agent is available for the stabilization in an integral copy sheet in which the stabilizing agent is present in a binder layer adjacent to the recording layer.

3. A recording process according to claim 1, wherein the recording material contains on a support a first layer comprising in a binder being a vinylcarbazole homopolymer or copolymer the photosensitive polyhalogen compound and a dye precursor compound, and the stabilizing agent or a mixture of stabilizing agents is contained in a polymeric binder in a covering layer applied to said first layer from a solvent that is a nonsolvent for the binder of said first layer.

4. A recording process according to claim 3, wherein the binder of the covering layer is cellulose nitrate.

5. A recording process according to claim 1, wherein the dye precursor compound is a spiropyran compound.

6. A recording process according to claim 1, wherein the at least one photosensitive organic polyhalogen compound contains carbon tetrabromide or a mixture of carbon tetrabromide and iodoform.

7. A recording process according to claim 1, wherein the $\alpha,\beta$-ethylenically unsaturated compound is available in the recording material in a molar amount being at least 2 times as large as the molar amount of the photosensitive polyhalogen compound.

8. An integral copy material containing a dye precursor compound, at least one photosensitive organic polyhalogen compound and a molar excess relative to said polyhalogen compound of a stabilizing agent or mixture of stabilizing agents, said polyhalogen compound and stabilizing agent being kept out of direct chemical contact with each other at a room temperature below 60° C in separate and adjacent polymeric binder layers but in such condition that reactive contact is effectable through heating of the material at a temperature above 60° C, and the stabilizing agent is selected from the group consisting of (1) triphenylamine, (2) a phenylselenide compound, and (3) an $\alpha,\beta$-ethylenically unsaturated compound having the structural formula:

$$X-(CH=CH-)_nY$$

wherein

X represents cyano, a cyanomethyl group, an acyl group, an acyloxy group, an alkoxycarbonyl group, an aryloxycarbonyl group, a carbomoyl group or an aryl group, Y represents hydrogen or a group represented by X, and $n$ is 1 or 2.

9. An integral copy material according to claim 8, wherein the polyhalogen compound and stabilizing agent(s) are contained out of chemical contact below 60° C in apart polymeric binder layers in which the layer comprising the stabilizing agent is a layer adjacent to the layer containing the photosensitive polyhalogen compound and is applied from a solution in a volatile liquid, which liquid is a non-solvent for the polyhalogen compound and for the binder of the layer containing said polyhalogen compound and the dye precursor compound.

10. An integral copy material according to claim 9, wherein the recording material contains on a support in a first layer a vinylcarbazole homopolymer or copolymer binder containing the dye precursor compound and photosensitive polyhalogen compound, and in a covering layer applied to said first layer the stabilizing agent in a polymeric binder that is applied from a solvent containing ethanol.

11. An integral copy material according to claim 10, wherein the covering layer contains a polymeric binder selected from the group comprising cellulose nitrate, polyvinyl acetate, ethylcellulose and polyvinylbutyral.

12. An integral copy material according to claim 8, wherein the $\alpha,\beta$-ethylenically unsaturated compound is present in said material in a molar amount being at least 2 times as large as the molar amount of the photosensitive polyhalogen compound.

13. An integral copy material according to claim 8, wherein the dye precursor compound is a spiropyran compound.

* * * * *